US005664879A

United States Patent [19]

Lai

[11] Patent Number: 5,664,879

[45] Date of Patent: Sep. 9, 1997

[54] CANDLESTICK HAVING LIGHTENING DEVICE

[76] Inventor: Chi-Shih Lai, No. 91, Lane 259, Szu Wei Rd., Panchiao, Taipei Hsien, Taiwan

[21] Appl. No.: 778,715

[22] Filed: Dec. 27, 1996

[51] Int. Cl.[6] ..... F21P 1/02

[52] U.S. Cl. ..... 362/392; 362/249; 362/252; 362/810

[58] Field of Search ..... 362/249, 392, 362/393, 447, 810, 102, 252, 171, 173

[56] References Cited

U.S. PATENT DOCUMENTS

| | | | |
|---|---|---|---|
| 1,861,360 | 5/1932 | Rebl | 362/392 |
| 2,061,824 | 11/1936 | Beymer | 362/810 |
| 2,496,618 | 2/1950 | Cox et al. | 362/249 |
| 4,903,179 | 2/1990 | Lin | 362/249 |
| 4,984,142 | 1/1991 | Garnerone | 362/252 |
| 5,036,442 | 7/1991 | Brown | 362/102 |
| 5,081,568 | 1/1992 | Dong et al. | 362/102 |

*Primary Examiner*—James C. Yeung

*Attorney, Agent, or Firm*—Morton J. Rosenberg; David I. Klein

[57] ABSTRACT

A candlestick with lightening device generally comprises a candlestick body, a base, a connecting sleeve, a shade, a primary bulb, a plurality of inner bulbs, and a plurality of connecting sockets. The bulb is disposed atop of the candlestick while those plurality of inner bulbs are disposed within the candlestick body. Accordingly, both primary bulb and inner bulbs are lightening when it is powered. By this arrangement, impressive and amiable atmosphere can be therefore attained.

3 Claims, 3 Drawing Sheets

CANDLESTICK HAVING LIGHTENING DEVICE

FIELD OF THE INVENTION

The present invention relates to a candlestick, more particularly, to a candlestick with lightening device such that a friendly and amiable environment can be created through the lights emitted from said lightening device.

DESCRIPTION OF THE PRIOR ART

In the conventional candlestick, a flame-type bulb is disposed atop. This bulb can be powered to emit lights therefrom. Accordingly, a flame-type light is created and this can be used to replace a real candle.

Nevertheless, in this conventional candlestick, only the bulb can emit a mild light while no lights can be emitted from the stick. Accordingly, this simple design will be phased out because of no creative design incorporated thereof. Even the outer surface of the stick is embossed for some beautiful patterns and designs, it is hard to attract attention since it is too dark to see it. In light of this, there is indeed a requirement to provide a genuine design to the candlestick which may provide friendly and amiable lights.

SUMMARY OF THE INVENTION

It is the object of this invention to provide a candlestick wherein the stick of the candlestick can emit amiable and friendly lights such that the design and patterns disposed at outer surface of the candlestick can be readily appreciated.

In order to achieve the object set forth, a candlestick with lightening device is provided which comprises a candlestick having a bulb at top. The stick of the candlestick is provided with a plurality of bulbs which can be powered to emit lights therefrom. Accordingly, the candlestick is more attractive and the patterns and designs incorporated at the outer surface of the stick can be readily appreciated by the people. The candlestick is more cost-effective and value-added.

BRIEF DESCRIPTION OF THE DRAWINGS

In order that the present invention may more readily be understood the following description is given, merely by way of example with reference to the accompanying drawings, in which.

Brief Description of Numerals

| | | | |
|---|---|---|---|
| 10 | candlestick body | 11 | base |
| 12 | connecting socket | 13 | shade |
| 14 | primary bulb | 15 | inner bulb |
| 16 | connecting socket | 17 | fixing groove |
| 18 | retaining hole | 19 | through hole |
| 20 | retaining portion | 21 | fixing tube |
| 22 | inserting groove | 23 | inserting portion |
| 24 | bulb socket | 25 | conducting wire |
| 26 | bulb socket | 27 | fixing hole |
| 28 | projected pin | 29 | pin hole |
| 30 | plug | | |

DETAILED DESCRIPTION OF PREFERRED EMBODIMENTS

Figure 1:
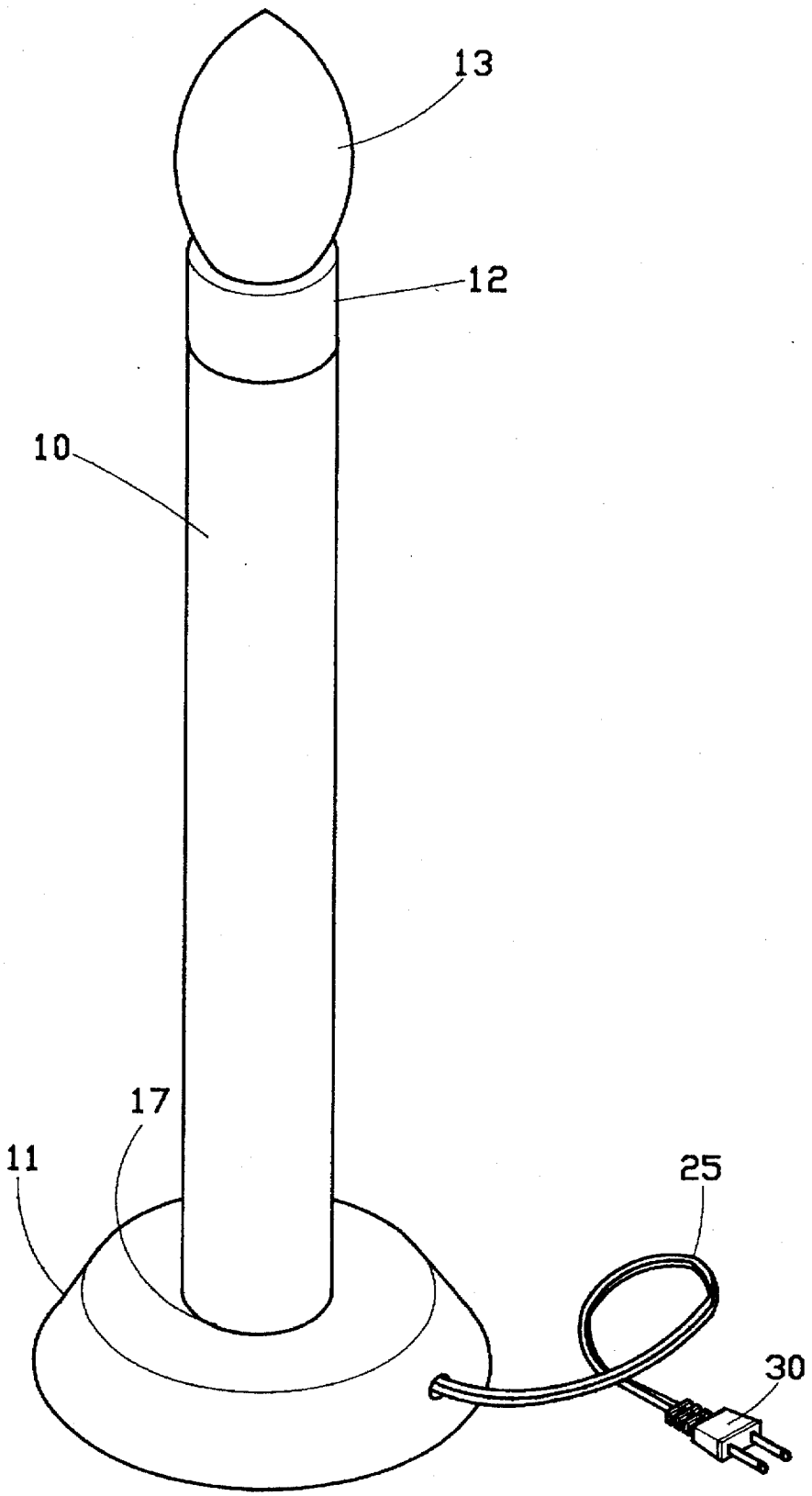
FIG. 1 is a perspective view showing the candlestick made according to this invention.
Figure 2:
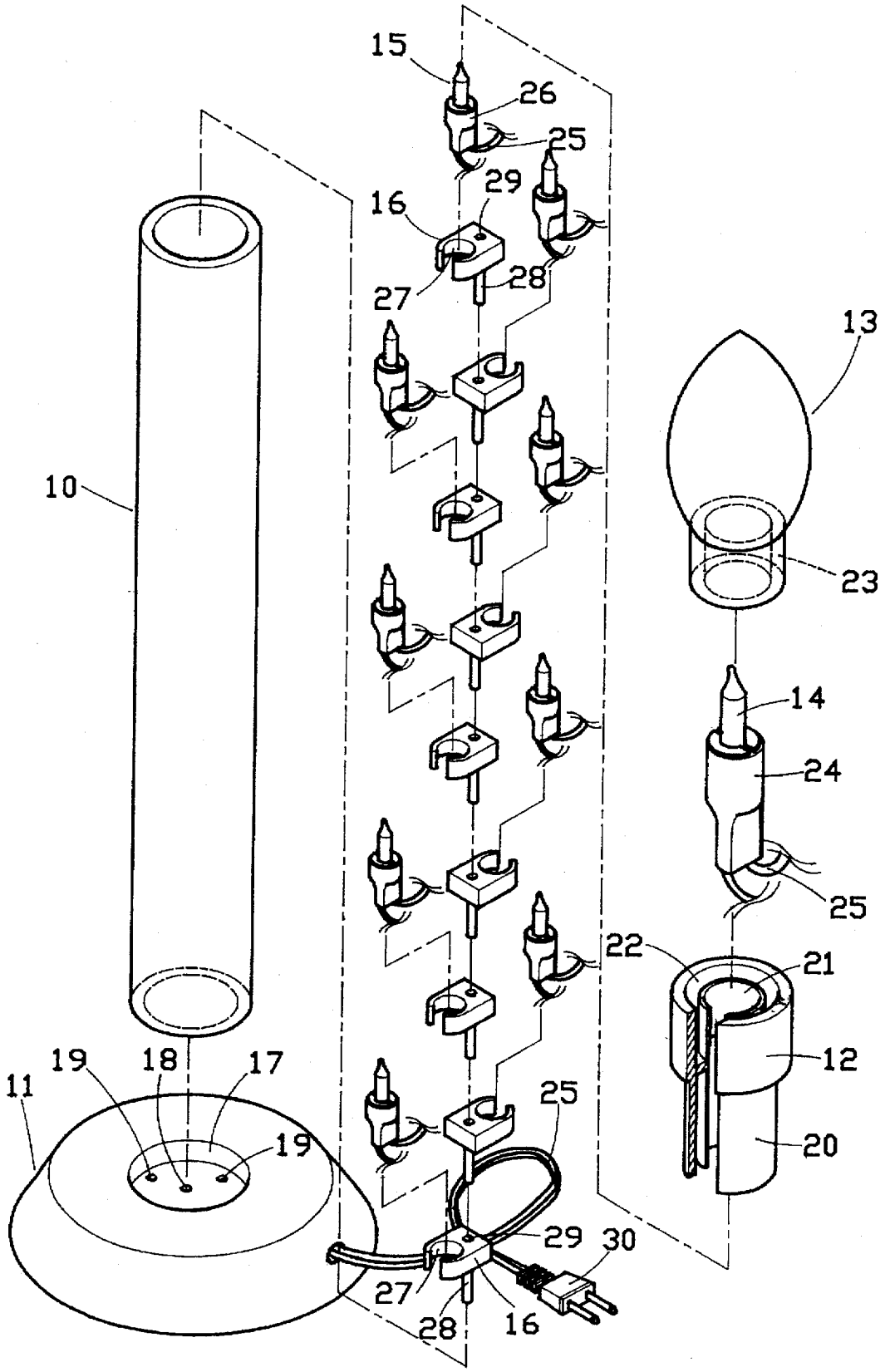
FIG. 2 is an exploded perspective view of the candlestick shown in FIG. 1.
Figure 3:
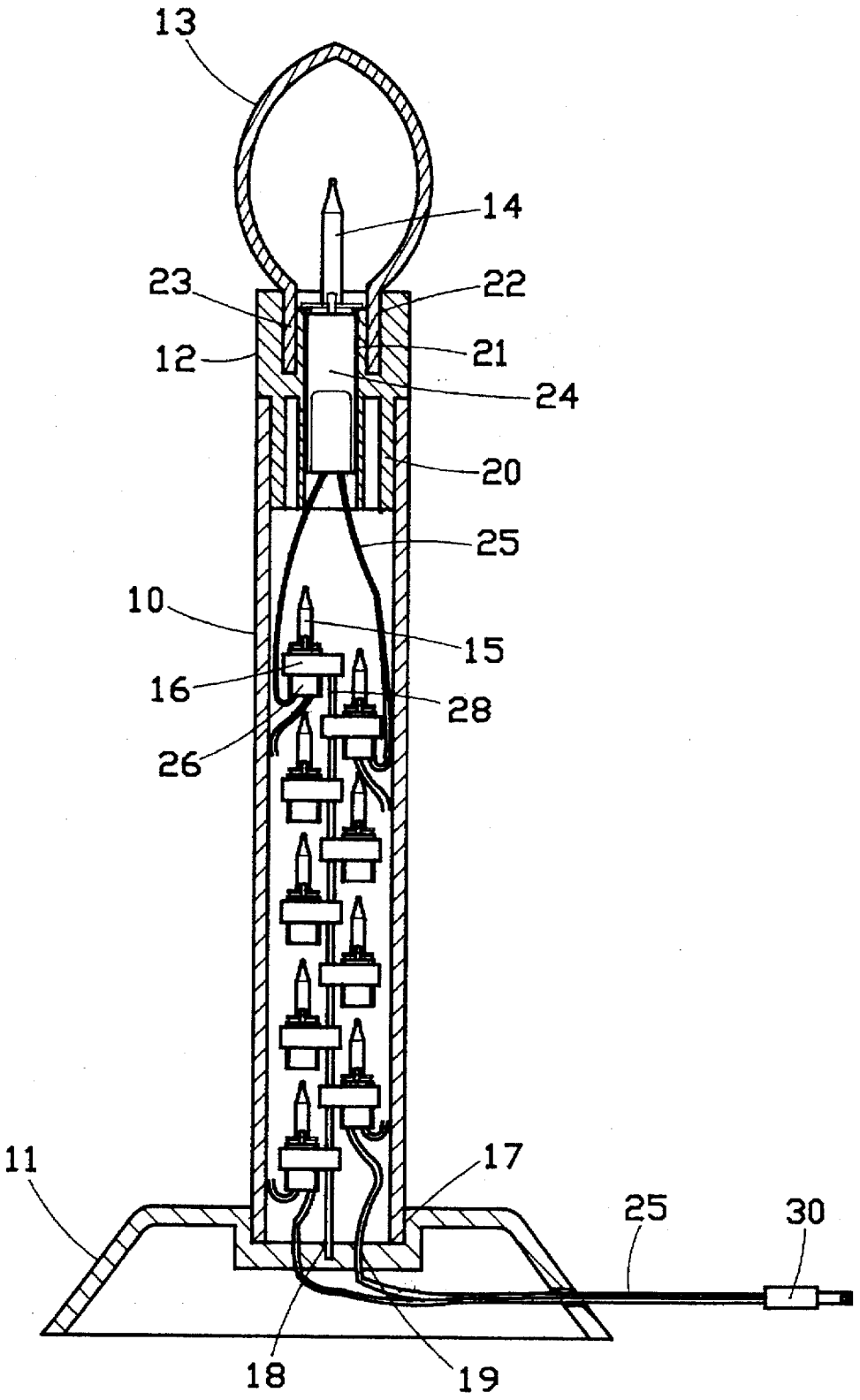
FIG. 3 is a cross sectional view showing the candlestick made according to this invention.

Referring to FIGS. 1, 2 and 3, a perspective view, exploded perspective view and cross sectional view are disclosed respectively. The candlestick made according to this invention generally comprises a candlestick body 10, a base 11, a connecting sleeve 12, a shade 13, a primary bulb 14, a plurality of inner bulbs 15, and a plurality of connecting sockets 16.

The candlestick body 10 has a hollow and tubular configuration which are made from transparent material. Both ends of the candlestick body 10 are opened. The outer surface of the candlestick is provided with designs and patterns to increase the aesthetic appearance.

The base 11 is attached to the lower end of said candlestick 10. A fixing recess 17 is disposed atop of said base 11 corresponding to the outer diameter of the lower end of said candlestick 10. The bottom of the fixing recess 17 is provided with a retaining hole 18 and a through hole 19. The lower end of the candlestick body 10 can be securely attached to the fixing recess 17 of said base 11 such that the candlestick body 10 is vertically erected and supported.

The connecting sleeve 12 is attached to the upper end of said candlestick 10 which has a retaining portion 20 to be engaged with the upper end of said candlestick body 10. A hollowed fixing tube 21 is disposed within said connecting sleeve 12. The connecting sleeve 12 further includes a inserting groove 22 such that the retaining portion 20 of said connecting sleeve 12 can be engaged and received within the upper end of said candlestick body 10. By this arrangement, the connecting sleeve 12 is attached to the upper end of said candlestick 10.

The shade 13 has a hollow and flame-type configuration. The shade 13 is attached to the top of said connecting sleeve 12 and is also made from transparent material. The shade 13 has an opening at lower end and extends an inserting portion 23 to be engaged with the inserting groove 22 of said connecting sleeve 12. When the inserting portion 23 is inserted and retained within said inserting groove 22, shade 13 is attached to the top of said connecting sleeve 12.

The primary bulb 14 is disposed within said shade 13 via a bulb socket 24. The connecting legs of said primary bulb 14 is electrically connected to the conducting wire 25, accordingly, the power can be supplied to the primary bulb 14. The bulb socket 24 is retained within the fixing tube 21 of said connecting sleeve 12 by an interference fit thereof, consequently, the bulb socket 24 and the primary bulb 14 can be fixed to the connecting sleeve 12, which in turn fix the primary bulb 14 securely within said shade 13.

A plurality of inner bulbs 15 are disposed within the candlestick 10. Each of the inner bulbs 15 is disposed on an individual bulb socket 26. Those inner bulbs 15 and electrically connected to said primary bulb 14 in serial. By this arrangement, the inner bulb 15 can be supplied with power.

A plurality of connecting sockets 16 are disposed within the candlestick 10. Each of the connecting sockets 16 is provided with a fixing hole 27 wherein the bulb socket 26 of the inner bulb 16 is retained within the fixing hole 27 by interference fit thereof. By this arrangement, the inner bulb 15 can be fixed on the connecting socket 16. The connecting socket 16 is provided with a projected pin 28 at the bottom and a pin hole 29 at top. By this arrangement, two adjacent connecting socket 16 can be engaged with each other by the connection between the projecting pin 28 and pin hole 29. Accordingly, a plurality of connecting sockets 16 can be connected in serial with the manner described above. When a preset number of connecting sockets are connected, the lowest connecting socket 16 can be engaged with the base 11 by the engagement between the projecting pin 28 and the retaining hole 18. Besides, the conducting wire 25 can be routed via the through hole 19 and extends outside. The plug 30 disposed at one end can be conveniently plugs into a wall socket for power supply.

In an alternative of preferred embodiment, a battery apartment can be disposed within the candlestick 10. Accordingly, the candlestick can be disposed in which the external power supply is not available.

Still in another preferable embodiment, those connecting sockets can be formed integrally, i.e. the projecting pin 28 of the connecting socket 16 is integrally formed with the adjacent connecting socket 16.

Referring to FIG. 3, a primary bulb 14 is disposed atop of the candlestick 10 wherein the bulb 14 may emit amiable lights when it is powered. By the way, the primary bulb 14 is specially designed to provide a flame-type appearance. On the other hand, since a plurality of inner bulbs 15 which are also lightened when powered on. In light of this, the designs and patterns incorporated in the outer wall of the candlestick 10 can be readily appreciated while another kind of impression is also provided by those inner bulbs 15.

Besides, since those connecting sockets 16 are connected with each other by projecting pin 28 and pin hole 29, accordingly, one connecting socket 16 can be readily rotated with another adjacent connecting socket 16 as centered on the projecting pin 28 and pin hole 29. By this arrangement, the inner bulb 15 can be disposed at a most suitable position wherein the designs and patterns incorporated at the outer wall of the candlestick 10 can be preferably manifested.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A candlestick with lightening device, comprising a candlestick body having a hollow configuration and being made from transparent material;

a base being attached to the lower end of said candlestick, a fixing recess being disposed atop, the bottom of said fixing recess being provided with a retaining hole and a through hole, wherein the lower end of said candlestick body can be securely attached to said fixing recess of said base;

a connecting sleeve having a retaining portion at lower end, a hollowed fixing tube being disposed within said connecting sleeve, said connecting sleeve further including a inserting groove such that said retaining portion of said connecting sleeve can be engaged and received within the upper end of said candlestick body;

a shade having a hollow and flame-type configuration and being made from transparent material, said shade having an opening at lower end which extends an inserting portion to be engaged with said inserting groove of said connecting sleeve;

a primary bulb being disposed within said shade via a bulb socket, said primary bulb being electrically connected to a conducting wire, said bulb socket of said primary bulb being retained within said fixing tube of said connecting sleeve by an interference fit thereof;

a plurality of inner bulbs being disposed within said candlestick, each of said inner bulbs being disposed on an individual bulb socket and being electrically connected to said primary bulb in serial; and a plurality of connecting sockets being disposed within said candlestick, each of said connecting sockets being provided with a fixing hole wherein said bulb socket of said inner bulb is retained within said fixing hole by interference fit thereof, said connecting socket being further provided with a projected pin at the bottom and a pin hole at top, consequently, two adjacent connecting socket can be engaged with each other by the connection between said projecting pin and pin hole while the lowest connecting socket can be engaged with said base by the engagement between said projecting pin and said retaining hole, a conducting wire being routed via said through hole and extended for external power supply.

2. A candlestick with lightening device as recited in claim 1, wherein the outer surface of said candlestick can be disposed with designs and patterns.

3. A candlestick with lightening device as recited in claim 1, wherein the candlestick body can be provided with battery apartment for power supply.

* * * * *